US005161854A

United States Patent [19]

Yokoto et al.

[11] Patent Number: 5,161,854

[45] Date of Patent: Nov. 10, 1992

[54] STRUCTURE OF SCREEN COVERING CLEARANCE BETWEEN SEAT BACK AND SEAT CUSHION IN A SEAT

[75] Inventors: Masaaki Yokoto; Masahiro Yoshida, both of Akishima, Japan

[73] Assignee: Tachi-S Co., Ltd., Japan

[21] Appl. No.: 614,846

[22] Filed: Nov. 9, 1990

[51] Int. Cl.[5] ..... A47C 31/00

[52] U.S. Cl. ..... 297/182; 297/219; 297/452; 297/456

[58] Field of Search ..... 297/218, 219, 229, 441, 297/452, 456, 182

[56] References Cited

U.S. PATENT DOCUMENTS

| | | | |
|---|---|---|---|
| 2,942,649 | 6/1960 | Wells | 297/219 |
| 3,107,365 | 10/1963 | Caldemeyer et al. | 297/456 X |
| 3,804,457 | 4/1974 | Hellman | 297/219 |
| 4,036,524 | 7/1977 | Takamatsu | 297/219 |

FOREIGN PATENT DOCUMENTS

| | | | |
|---|---|---|---|
| 488600 | 7/1938 | United Kingdom | 297/219 |
| 499162 | 1/1939 | United Kingdom | 297/218 |

*Primary Examiner*—Peter R. Brown

*Attorney, Agent, or Firm*—Oldham, Oldham & Wilson Co.

[57] ABSTRACT

A structure of screen for covering a clearance between seat back and seat cusion in a seat, in which a creeen member is provided between the lower end of the seat back and the rearward end of the seat cushion, with the arrangement that the upper edge of the screen member is formed with a space under seat back, which defines a slit for insertion of a fork-lift's carrying rod thereinto, and a fastening plate is fixed at the upper end area of the screen member. The fastening plate is removably secured to the lower end area of the seat back, thereby permitting for closing and opening of the screen member.

4 Claims, 3 Drawing Sheets

STRUCTURE OF SCREEN COVERING CLEARANCE BETWEEN SEAT BACK AND SEAT CUSHION IN A SEAT

BACKGROUND OF THE INVENTION

1. Field of the Invention

The present invention relates to a structure of a screen cloth which is provided between the lower end of a seat back and rearward end of a seat cushion, to cover a clearance between the seat back and cushion associated with an automotive seat 2. Description of Prior Art A common step in assembling together a seat back and seat cushion, during seat assemblage, involves spacing apart the lower end of the seat back from the rearward end of the seat cushion, with a view to avoiding a frictional contact therebetween.

Another reason for creating such clearance between the seat back and cushion is based on a transfer purpose using a fork-lift: Ordinarily, to transfer a heavy powered seat having plural mechanical elements, such as a reclining device, seat lifter and the like, a worker drives a fork-lift to insert its a pair of fork-like carrier rods into the clearance between he seat back and seat cushion, then lifting the seat and bringing it into the interior of an automobile.

However, in a seat of the type wherein a screen cloth is stretched over the clearance between its seat back and cushion for improving outer aesthetic appearance of the seat, the above second purpose is not achieved as the screen cloth becomes an abstacle against the insertion of the two fork-like rods into the clearance between seat back and seat cushion. Example of a conventional seat having such screen cloth is shown in FIGS. 1 and 2, according to which a screen cloth (S) is provided between the lower end of the seat back (SB) and the rearward end of the seat cushion (SC). The screen cloth (S) is at its upper end connected to a covering member (32) of the seat back (SB) by means of a hog ring (36), and at its lower end sewn integrally with a covering member (42) of the seat cushion (SC). As a result, the screen cloth (S) is in no way separatable from the clearance between the seat back (SB) and seat cushion (SC).

SUMMARY OF THE INVENTION

In order to solve the above-stated prior art problem, it is a purpose of the present invention to provide an improved structure of screen for covering a clearance between seat back and seat cushion in a seat, which permits not only for completely covering the clearance, but also opening the screen for enabling insertion of a carrying member of a transferring machine into the clearance.

To attain such purpose, in accordance with the present invention, a screen member is provided between a lower end of the seat back and a rearward end of a seat, to prevent creation of a clearance therebetween, wherein the screen member is at its lower end fixed to the seat cushion and at its upper end portion provided fixedly with a fastening plate of a hard material, wherein a back board is attached over a rear side of the seat back, and wherein the fastening plate is removably secured to a lower end part of the back board.

Accordingly, the fastening plate is to be secured to the lower end part of the back board, to thereby covers the clearance between the seat back and seat cushion, while the fastening plate is to be removed from that part of the back board, then giving a space into which a carrying member of transferring machine, such as fork-lift, may be inserted.

DETAILED DESCRIPTION OF PREFERRED EMBODIMENT OF THE INVENTION

Referring to FIGS. 3 to FIGS. 6, there is illustrated a screen-cloth structure in accordance with the present invention, which is arranged in an automotive seat (S) with a view to covering a clearance between a seat back (SB) and a seat cushion (SC) of the seat (S).

Figure 1:
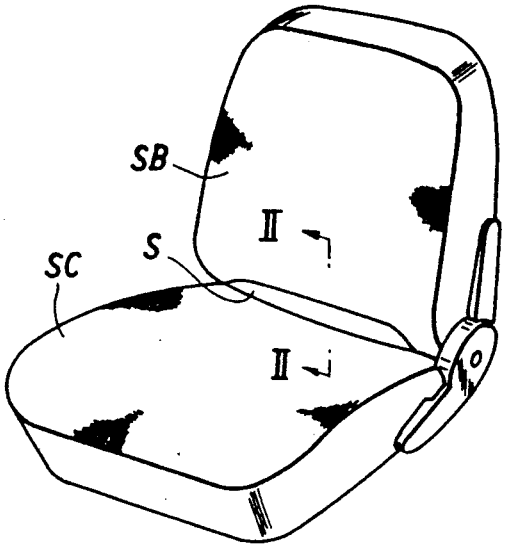
FIG. 1 PRIOR ART
FIG. 1 is a perspective view of a seat having a conventional structure of screen for covering a clearance between seat back and seat cushion.
Figure 2:
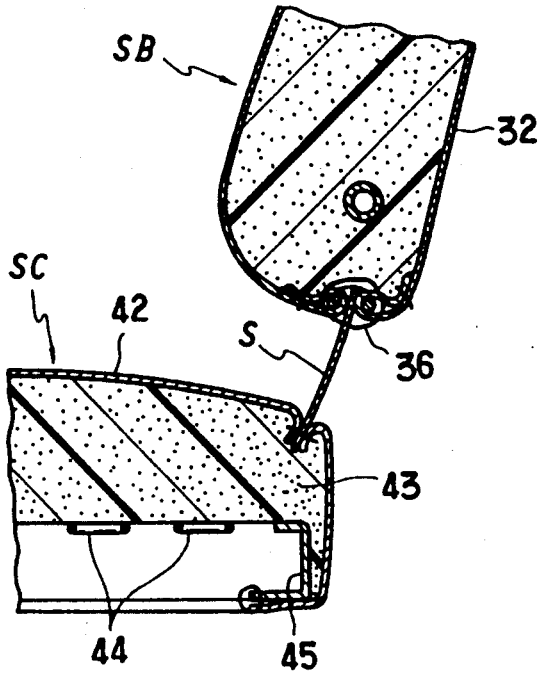
FIG. 2 PRIOR ART
FIG. 2 is a sectional view of the conventional structure in the FIG. 1, showing a screen member between the seat back and seat cushion.
Figure 3:
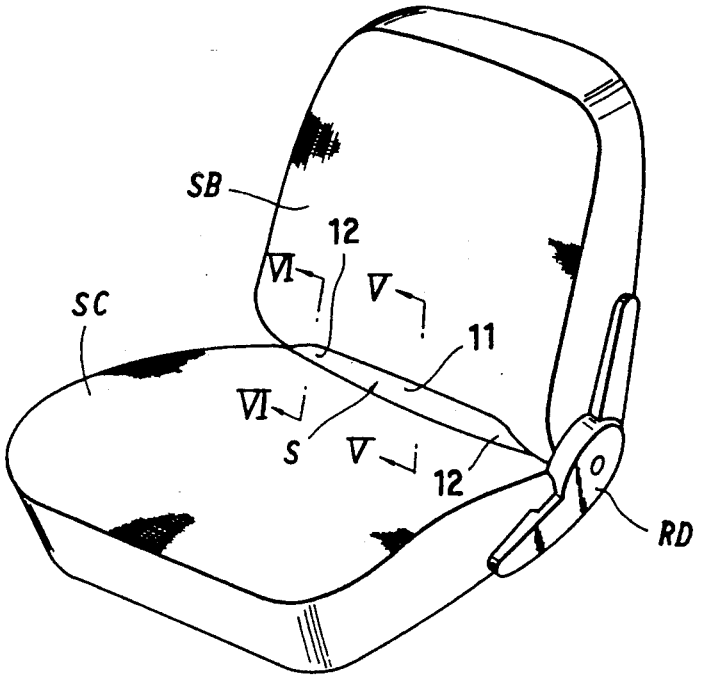
FIG. 3 is a perspective view of a seat to which is applied a screen structure in accordance with the present invention.
Figure 4:
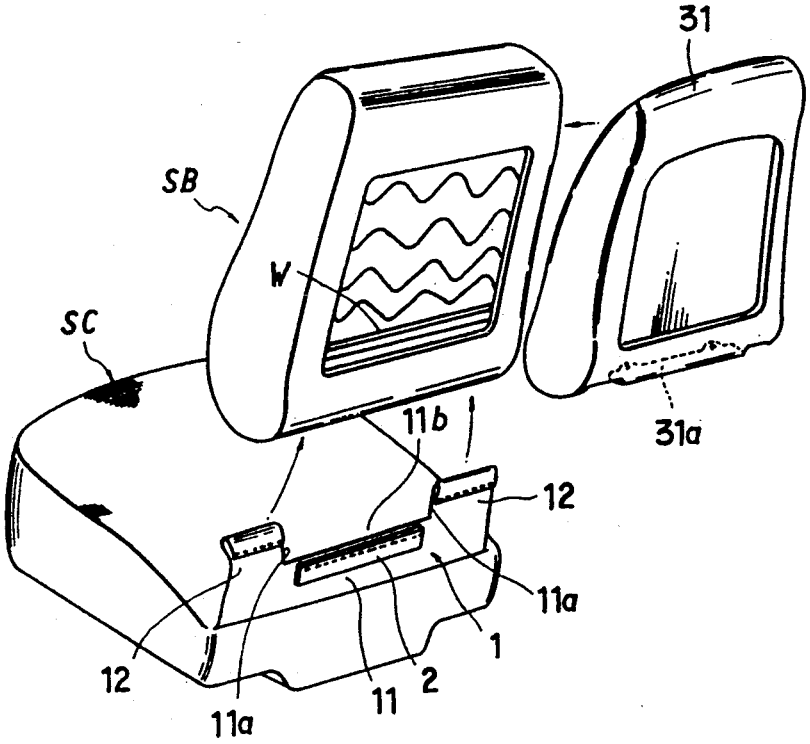
FIG. 4 is an exploded perspective view of the seat in the FIG. 3.
Figure 5:
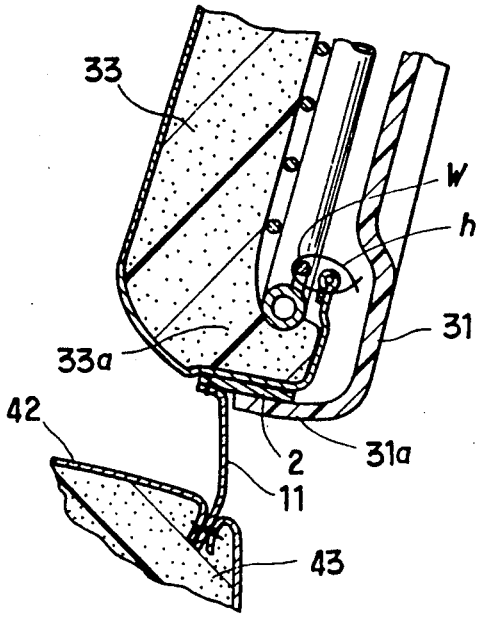
FIGS. 5(A) and 5(B) are partly broken sectional views taken along the line V—V in the FIG. 4, which explain the use of a principal part of the present invention.
Figure 5:
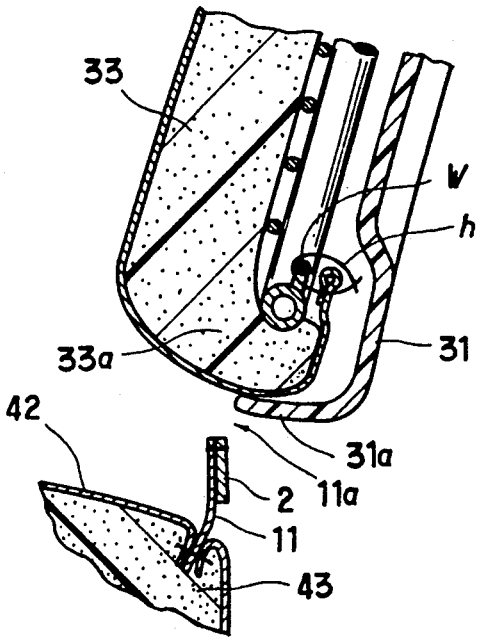

FIGS. 3 and 4 show an automotive seat, to which the present invention is applied, to be comprised of a seat back (SB) and a seat cushion (SC) such that the seat back (SB) is connected via a reclining device (RD) to the seat cushion (SC). Between the lower end of the seat back (SB) and rearward end of the seat cushion (SC), there is defined a clearance (S).

Figure 6:
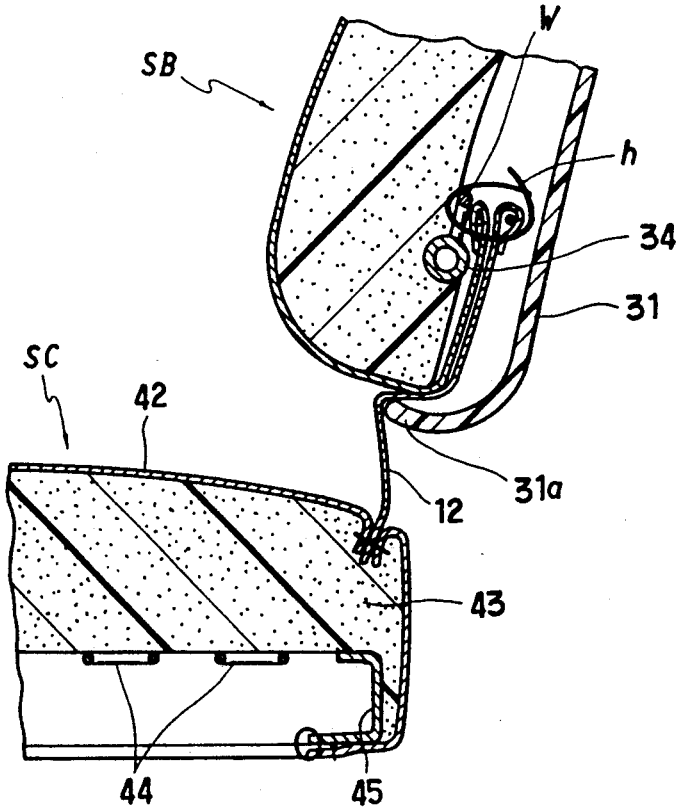
FIG. 6 is a partly broken sectional view taken along the line VI—VI in the FIG. 4.

As can be seen from FIGS. 5(A), 5(B) and 6, the seat back (SB) is formed by a covering member (32), a foam cushion member (33), with a seat back frame (34) being fitted within the cushion member (33) and plural sinuous springs (35) extended between both lateral frame sections of the frame (34), whereas on the other hand, the seat cushion (SC) is formed by a covering member (42) and a cushion member (43), with a seat cushion frame (44) being fitted in the cushion member (43) and plural sinuous springs (45) extended between side frame sections of the frame (44). Specifically stated, the formation of the seat back (SB) is such that the frontal surface of the cushion member (33) is covered with the covering member (32), with the terminal ends of the covering member (32) being secured by a hog ring (h) to a wire (w) which extends inwardly of and along the back frame (34), thus defining, at the rear side of the seat back (SB), an opened area through which the springs (35) may be viewed, as from FIG. 4. To such rear side of the seat back (SB), there is attached firmly a back board (31).

Designation (1) represents a screen member made of an elastic cloth or an elastic film, which is for covering the foregoing clearance (S) between the seat back (SB) and seat cushion (SC), to thereby improve an aesthetic appearance of the seat.

As best shown in FIG. 4, the screen member (1) is formed by cutting a strip of screen base material such as to define therein a pair of upwardly projected areas (12)(12) and an intermediate area (11) between those two projected areas (12)(12). The two projected areas (12)(12) each extend from the upper edge of the intermediate area (11) a distance as indicated by designation (11*a*), terminating in a loop-like securing part (12*a*). The thus-formed projected areas (12) form an upper securing part of the screen member (1), as will be understood later. Accordingly, there is defined a space (11*b*) above the upper edge of the intermediate area (11) as well as between the two upper securing parts (12)(12). It should be noted here that the distance (11*a*) is a criterion for determining a slit which is established between the upper edge of the intermediate area (11) and the lower end of the seat back (SB), as will be explained, such as to have a minimum dimensions for two spaced-apart fork-like carrying rods of a fork-lift (not shown) to be inserted thereinto. At the intermediate area (11) and along the upper edge thereof, is sewn a fastening plate (2), in such a manner that the upper end area of the plate (2) is sewn over its total length to the intermediate area (11), thereby giving a non-sewn free end on the side opposed thereto.

The thus-formed screen member (11) is at its lower edge sewn with the covering member (42) at the rearward end of the seat cushion (SC). As seen from FIG. 4, the screen member (11) is of a length generally equal to the width of the seat cushion (SC).

The two upwardly projecting securing parts (12) (12) are secured to the wire (w) by hog ring (h) in the opened area at the rear side of the seat back (SB), as seen from FIG. 6. Then, the back board (31) is attached over the rear side of the seat back (SB), such that a generally horizontally extending lower end part (31*a*) of the back board (31) is interposed between the two securing parts (12*a*), just at the slit (11*a*), and further underlies the lower end area (33*a*) of the seat back (33) in a light contact therewith.

Normally, as shown in FIG. 5(A), the free end part of the fastening plate (2) is inserted in between the lower area (33*a*) of the seat-back cushion member (33) and the afore-said lower end part (33*a*) of the back board (33), whereupon it is seen that the intermediate area (11) of the screen member (1) is stretched vertically, covering the slit (11*b*), which cooperates with the two securing parts (12), which cover the clearance (S) stated above at its both lateral sides, to completely cover the clearance (S) and thus conceal it from view.

The fastening plate (2) is retained positively against removal between the lower end area (33*a*) of seat cushion (33) and that (31*a*) of the back board (31), owing to outwardly resiliently expanding property of the cushion member (33).

But, as shown in FIG. 5(B), to remove the fastening plate (22) from between the cushion lower area (33*a*) and back-board lower end part (31*a*) will allow the intermediate area (11) to recover its normal stretching state, producing a slit (11*b*) under the seat back (SC), corresponding to the space (11*b*) defined by the distance (11*a*) of the two upwardly extending securing parts (12). Then, into such slit (11*b*), the aforementioned two fork-lift's carrying rods may be inserted, so that the seat (S) may be transferred by a fork-lift at the step for mounting the seat (S) in the interior of an automobile. After such seat transfer, having the two fork-lift's carrying rods disengaged from the slit (11*b*), the fastening plate (2) is again inserted into between the cushion lower area (33*a*) and back-board lower part (31*a*), as in FIG. (5A), in order to cover the clearance (S) completely.

The fastening plate (2) is preferably made of a semi-rigid material such as a polyvinyl chloride material or a hard synthetic resin material.

While having described the present invention, it should be understood that the invention is not limited to the illustrated embodiment, but any other modification, replacement and addition may structurally be possible without departing from the spirit and scope of the appended claims.

What is claimed is:

1. A structure of screen for covering a clearance between a seat back and a seat cushion in a seat, wherein a screen member is provided between a lower end of said seat back and a rearward end of said seat cushion, the thereby prevent creation of a clearance therebetween, wherein said screen member is at its lower end fixed to said seat cushion and at its upper end portion provided fixedly with a fastening plate of a hard metal, wherein a back board is attached over a rear side of said seat back, wherein said fastening plate is removably secured to a lower end part of said back board, wherein said screen member is formed by cutting a strip of a base material such as to define therein a pair of upwardly projected side sections and an intermediate section between said two side sections, such that a space portion is defined above an upper edge of said intermediate section as well as between said two upwardly projected side sections, wherein said screen member is of a length equal substantially to a width of said seat cushion, wherein the upper edges of said two side sections of said screen material are each secured to respective lateral areas of said seat back, while the lower end of said screen material is fixed over its total length to said seat cushion, and wherein said fastening plate is provided at the upper edges of said intermediate section of said screen member.

2. The structure as defined in claim 1, wherein said lower end of said back board is so formed that it is bent forwardly from said back board, extending from an intermediate area of said back board, wherein said seat back includes a covering member and a foam cushion member covered with said covering member, wherein said bent lower end of said back board underlies a lower end portion of said seat back, and wherein said fastening plate is inserted in between said lower bent end of said back board and said lower en portion of said seat back, whereby an outwardly, resiliently expanding property of said foam cushion member serves to positively retain said fastening plate at the seat back.

3. The structure as defined in claim 1, wherein said two securing sections of said screen member are secured, by means of hog rings, to a wire provided at said rear side of said seat back, and wherein said back board is attached over said rear side of said seat back, whereby said two securing sections, hog rings and wire are thereby concealed from view.

4. The structure as defined in claim 1, wherein said space defined in said screen member is so dimensioned to allow two fork-like carrying rods of a fork-lift to be inserted thereinto and further allow upward stretching of said intermediate section of said screen material towards said lower end of said seat back in order to enable securing of said fastening plate onto said lower end part of said back board.

* * * * *